US011739487B2

(12) United States Patent
Pflieger et al.

(10) Patent No.: US 11,739,487 B2
(45) Date of Patent: Aug. 29, 2023

(54) CONFIGURABLE DAM GATE HOIST

(71) Applicants: David C. Pflieger, Wausau, WI (US); Micheal H. Sprague, Birnamwood, WI (US)

(72) Inventors: David C. Pflieger, Wausau, WI (US); Micheal H. Sprague, Birnamwood, WI (US)

(73) Assignee: Lemke Industrial Machine LLC, Marathon, WI (US)

( * ) Notice: Subject to any disclaimer, the term of this patent is extended or adjusted under 35 U.S.C. 154(b) by 394 days.

(21) Appl. No.: 16/984,781

(22) Filed: Aug. 4, 2020

(65) Prior Publication Data

US 2022/0042265 A1 Feb. 10, 2022

(51) Int. Cl.
*E02B 7/36* (2006.01)

(52) U.S. Cl.
CPC ..... *E02B 7/36* (2013.01)

(58) Field of Classification Search
CPC ..... E02B 7/26–36
See application file for complete search history.

(56) References Cited

U.S. PATENT DOCUMENTS 1,784,955 A * 12/1930 Ballard ..... E02B 13/02 405/91

* cited by examiner

*Primary Examiner* — Tara Mayo
(74) *Attorney, Agent, or Firm* — Ruder Ware, L.L.S.C.

(57) ABSTRACT

A configurable modular dam gate hoist system is disclosed. The dam gate hoist system includes a first hoist support frame, second hoist support frame, first side segment with a first adjustable hoist drum, second side segment with a second adjustable hoist drum, a hoist drive assembly, and optionally a middle segment. The middle segment, when utilized, is constructed of pre-made components with set lengths in the factory, with the length of the middle segment being varied by using components with different set lengths. Both the first and second side segments include an adjustment slot or keyway that receives adjustment bolts (preferably including standard square keys) of the first and second adjustable hoist drum to allow the position of the drums to be adjusted and secured in the desired location on the tube to correspond with the desired fleet angle of the gate chain, cable, or wire rope.

24 Claims, 10 Drawing Sheets

CONFIGURABLE DAM GATE HOIST

BACKGROUND OF THE INVENTION

The invention disclosed herein relates to a dam gate hoist system and, more specifically, a dam gate hoist that is modular and configurable such that the hoist may be used with a variety of dam gate dimensions and weights and chain, cable, and wire rope configurations.

Hydraulic gates are a form of control equipment used for controlling the flow of water through a spillway or other component of a dam, or similar type of structure. When in its closed position, the gate holds the water on the upstream side of the dam. When the water level on the upstream side increases above the level desired by the dam operator (either due to downstream generation needs, water flow requirements, or safety or environmental considerations), the gate is opened to allow water through the spillway or other similar component (including, in some cases, the power generation components) of the dam, thereby increasing the downstream flow of water exiting the dam and reducing the water level upstream from the dam.

Gates may take a variety of classifications, based on (a) the general purpose and location of the gate, (b) the general shape of the gate itself, or (c) the mode of movement of the gate. Examples of gates classified by the purpose and location of the gates include spillway gates, barrage or pick up weir gates, power outlet or intake gates, draft tube gates, or outlet/sluice/head regulator gates. Examples of gates classified by the shape of the gates include radial/Tainter gates, cylindrical gates, plane rectangular gates, or sector or drum gates. Finally, examples of gates classified by the mode of movement of the gate include vertical lift gates, radial/Tainter gates, and automatic functioning gates.

The dam gate hoist system of the present invention may be used with gates of any general purpose and location and are intended to be used as the gate hoist for radial/Tainter gates, plane rectangular gates, and vertical lift gates.

Radial/Tainter gates consist of a curved plate reinforced with structural members, and radial/Tainter arms transmitting the water pressure to two trunnion bearings. Radial/Tainter gates rotate about a horizontal axis, which passes through the centers of trunnion bearings and usually coincides with the axis of the skin plate. Typically a hoist connected to the curved plate through chains, cables, or wires is used to open and close the gate. Sometimes the center of plate curvature is placed above the trunnion center line to provide a lifting moment assisting the hoist in operating the gate.

Plane rectangular gates and vertical lift gates typically consist of a rectangular-shaped plate, usually reinforced with structural members, mounted vertically. Typically a hoist is connected to the top of the plate, and chains, cables, or wires are used to open and close the gate (although, in some instances, the gates are lifted by gears engaging teeth mounted on the plate or screw-like stems mounted to the top of the plate).

A dam gate hoist is a piece of equipment which lifts or lowers the dam gate at the required speed of travel and holds the gate in a partially open position as desired. For example, on a spillway gate, the hoist is either installed on a hoist bridge supported by the piers of the dam or directly over the piers. Similarly, for other purposes and locations of gates, the hoist is typically mounted above the gate on the structure of the dam.

The essential requirements of a dam gate hoist are reliability in operation, smooth and consistent functioning (to avoid any jerking on gates or gate chains, cables, or wire ropes while operating), and the ability to sustain the vibrations of the gate when the gate is held partially open.

Prior art gate hoists typically needed to be custom "fitted" to a particular dam, as the width of the dam gate and the location of the chains, cables, or wire ropes for raising or lowering the gate were highly variable based upon the particular design, configuration, dimensions, and location of the structure of the dam itself (including the spillway or other component design) and the overhead structure (such as the hoist bridge or piers of the dam) to which the hoist is to be secured. That is, while the general components of a dam hoist (a hoist drive assembly and drive shaft) remain consistent, the length of the drive shaft, location of the drums for the chains, cables, or wire ropes for raising the gate, configuration of the drive shaft supports and other necessary components must be designed and fabricated for each individual installation.

This need for high levels of customization results in long design and construction times which often result in significant lead-time requirements when a dam is constructed. Likewise, in the event that an existing dam gate hoist requires emergency replacement due to mechanical or other problems, this often results in significant delays (typically measured in months) in the replacement of the dam gate hoist. These result in higher manufacturing and installation costs of dam gate hoists and, in emergency situations, may give rise to public safety issues if the dam hoist needing replacement services the only or one of very few dam gates at a particular location. In fact, in some circumstances, a dam operator must come up with ad hoc or jury-rigged methods for raising and lowering the dam gate, which is not desirable.

As such, there is a considerable need in the art for a modular or configurable dam gate hoist that consists of pre-manufactured components that can be quickly assembled and adjusted, tested, transported to, and installed on a dam to operate a dam gate. The present invention provides such a modular and configurable dam gate system that may be used with a wide variety of dam gate dimensions and weights and chain, cable, and wire rope configurations.

BRIEF SUMMARY OF THE INVENTION

It is a feature of the present invention to provide a modular and configurable dam gate hoist system that may be configured to be used with dam gates of a variety of dimensions and weights, as well as a variety of gate configurations.

The configurable dam gate hoist system 10 of the present invention includes a first hoist support frame 12, second hoist support frame 14, first side segment 16, second side segment 18, and a hoist drive assembly 20. The configurable dam gate hoist 10 may also optionally include a middle segment 22; that is, the configurable dam gate hoist 10 of the present invention may entirely omit the middle segment 22, such that only the first side segments 16 and second side segments 18 are utilized as a tube 24 without departing from the scope of the present invention. The first side segment 16 includes a first hoist drum 26 for receiving one of the chains, cables, or wire ropes 102 attached to the dam gate. The second side segment 18 includes a second hoist drum 28 for receiving the other chain, cable, or wire rope 102 attached to the dam gate.

The first side segment 16 and the second side segment 18 each include a drum adjustment keyway or slot 30, or other similar means for engaging the first hoist drum 26 and second hoist drum 28, respectively, running longitudinally along the surface of the first side segment 16 and the second side segment 18.

The first hoist drum 26 and second hoist drum 28 each include one or more adjustment bolts 32 that are received by the drum adjustment keyway or slot 30 of the corresponding side segment. Preferably, the adjustment bolts 32 include an industry standard square key that is received by the drum adjustment keyway or slot 30 of the corresponding side segment. When the adjustment bolts 32 are in a loosened configuration, the adjustment bolts 32 allow the longitudinal position of the first hoist drum 26 or second hoist drum 28 to be adjusted along the first side segment 16 or second side segment 18 respectively. Then, when the desired position for the first hoist drum 26 and second hoist drum 28 are reached, the adjustment bolts 32 are rotated into a tightened configuration where the adjustment bolts 32 engage the corresponding drum adjustment keyway or slot 30, thereby securing the first hoist drum 26 and second hoist drum 28 to the first side segment 16 and second side segment 18, respectively. Thus, once the adjustment bolts 32 have been tightened the first hoist drum 26 and second hoist drum 28 are held in the position that corresponds with the desired fleet angle of the chains, cables, or wire ropes 102 of the dam gate to allow the dam gate to be raised and lowered properly. One end of each chain, cable, and wire rope 102 of the dam gate is secured to the corresponding first hoist drum 26 or second hoist drum 28. It should be noted that while adjustment bolts 32 are discussed herein, alternatively any other means of axial locking the first hoist drum 26 and the second hoist drum 28 to the first side segment 16 and the second side segment 18, respectively, which allows the transmission of torque from the first side segment 16 and the second side segment 18 to the first hoist drum 26 and the second hoist drum 28, respectively, known in the art may be utilized.

The general design of the outer surface of the first hoist drum and second hoist drum varies based upon whether the configurable dam gate hoist will be used with a dam gate with cables, wire ropes, or chains. If cables or wire ropes will be used to raise and lower the dam gate, the first hoist drum and second hoist drum have a generally smooth surface with flanges or lips extending upward from the surface at each end of the drum for holding the cables or wire ropes while they coil around each drum. If chains will be used to raise and lower the dam gate, the surface of the first hoist drum and the second hoist drum includes a slot that corkscrews along the surface of the drum to hold the thicker chains as they coil around each drum. A drum of one type may be exchanged for the drum of the other type when the configurable dam gate hoist is being configured by removing the drum from the respective side segment by sliding it off of the end of the side segment and sliding the drum of the desired design back onto the side segment and securing it to the side segment.

When used, the optional middle segment 22 has a length selected from several length options at the manufacturing facility. That is, middle segment components having one or more different pre-selected lengths are manufactured at the manufacturing facility and then the final middle segment 22 having a length corresponding to the necessary length of the dam gate hoist given the dimensions of the dam piers of a particular dam gate is selected such that the positions of the load bearing first hoist support frame 12 and second hoist support frame 14 may be placed where required.

When the first side segment 16 and second side segment 18 are joined together, they form a tube 24 of the configurable dam gate hoist 10. Likewise, when the optional middle segment 22 is utilized, the first side segment 16, middle segment 22, and second side segment 18 are joined together, they form a tube 24 of the configurable dam gate hoist 10.

The first hoist support frame 12 secures the tube 24 to the desired load bearing location on the dam structure while allowing the tube 24 to rotate relative to the first hoist support frame 12. The first hoist support frame 12 also includes the hoist drive assembly 20.

The hoist drive assembly 20 is a standard rotary drive or motor that rotates the tube 24, thereby raising the dam gate by coiling the chain, cable, and wire rope 102 around the first hoist drum 26 and second hoist drum 28 of the configurable dam gate hoist 10. In one preferred of the present invention, the motor of the hoist drive assembly 20 includes integral torque limits and integral travel limits so that the hoist drive assembly 20 can be configurable to site specific lifting conditions of the dam gate, which will protect the dam gate from excessive lifting forces and gate overtravel. An example of a torque limiter that may be utilized is an electromechanical spring pack and an example of a travel limiter that may be used is an electromechanical rotary gear pack. However, alternatively, any torque or travel limiter known in the art may be used.

The second hoist support frame 14 secures the tube 24 *t* to the desired load bearing location on the dam structure opposite the first hoist support frame 12, while allowing the tube 24 to rotate relative to the second hoist support frame 14.

Thus, the present invention provides a modular and configurable dam gate hoist 10 that may be used with spillway and dam gates of various dimensions and weights having a variety of gate chain configurations by having a modular design where tubes of a variety of pre-determined lengths may be made from pre-made standardized components (either the first and second side segments 16, 18 or the first and second side segments 16, 18 together with the optional middle segment 22) at the factory and the hoist drums 26, 28 may be longitudinally adjusted along the side segments 16, 18 of the tube 24 to correspond with the desired fleet angle of the chains, cables, or wire ropes 102 of the dam gate, rather than requiring a tube of a custom length and hoist drums having a custom location longitudinally along the tube to be manufactured based upon the specific dimensions of a dam gate and associated structure of a dam. The present invention therefore greatly reduces the time and expense necessary to manufacture and install a dam gate hoist, or to replace an existing dam gate hoist in an emergency.

DETAILED DESCRIPTION OF THE PREFERRED EMBODIMENT(S)

The present invention provides a modular and configurable dam gate hoist 10 for use with dam gates of various dimensions and weights having a variety of gate chain, cable, or wire rope configurations.

Figure 1:
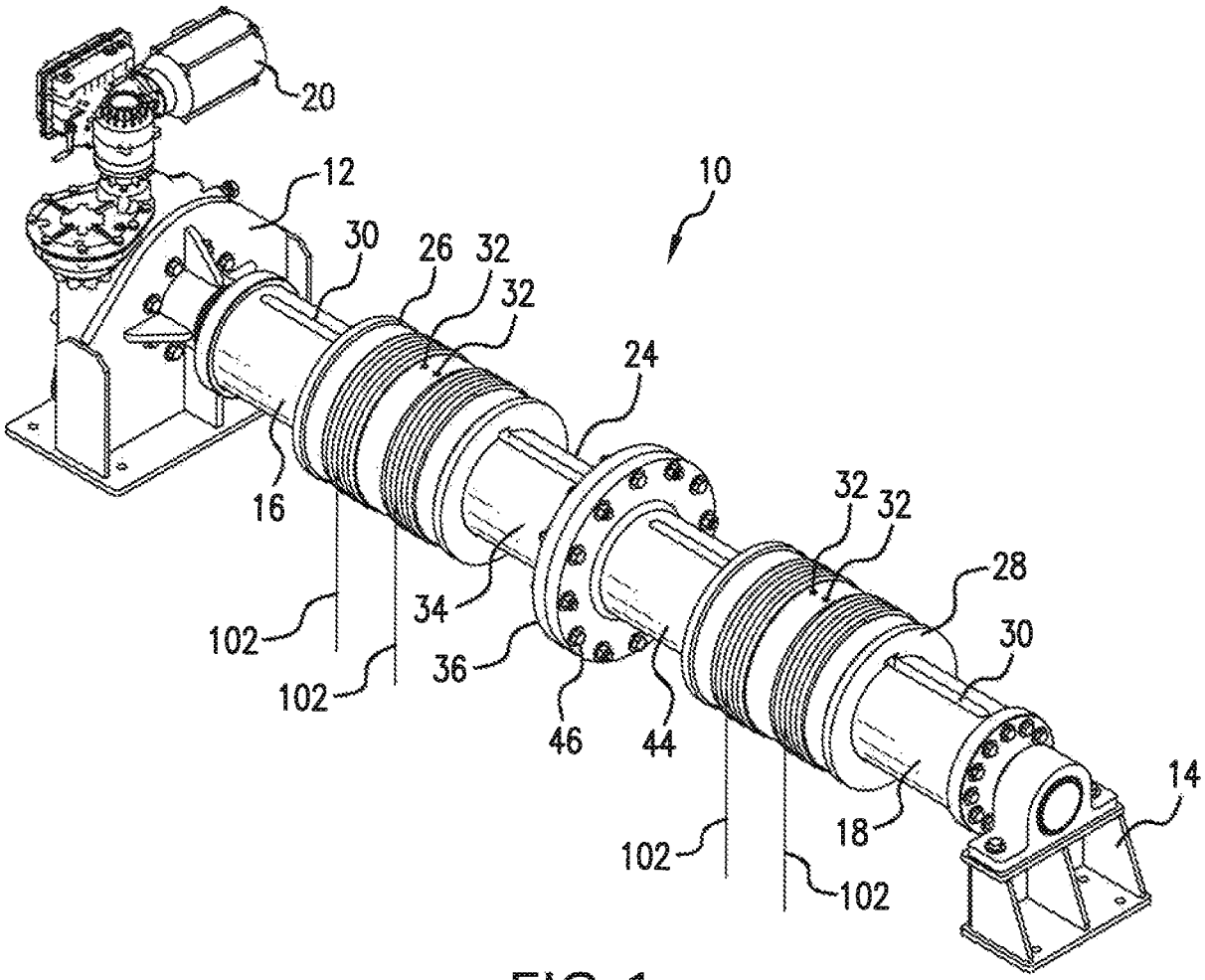
FIG. 1 shows a perspective view of the configurable dam gate hoist of the present invention without the optional middle segment shown with a hoist drum design used with cables or wire ropes.
Figure 2:
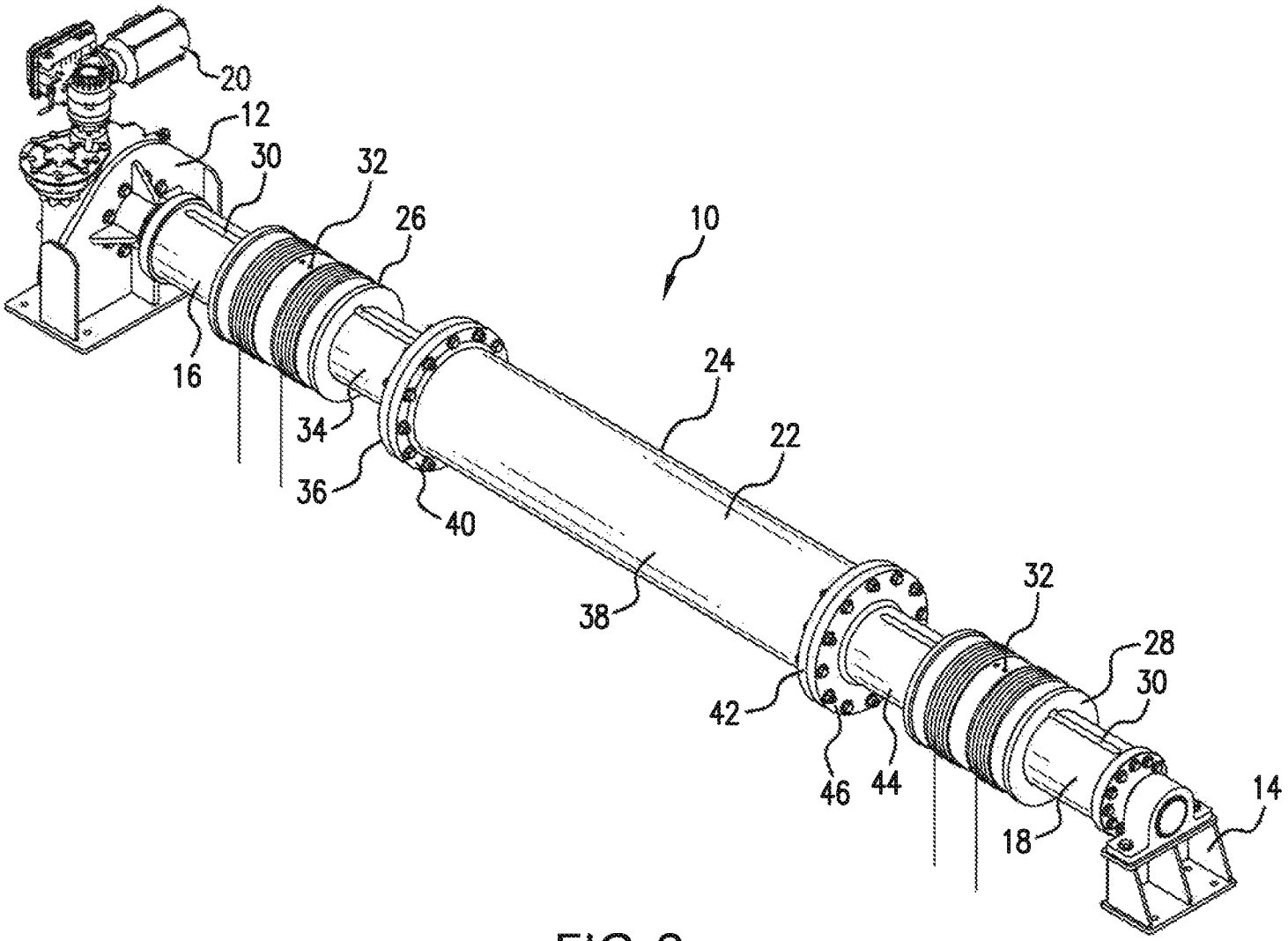
FIG. 2 shows a perspective view of the configurable dam gate hoist of the present invention with the optional middle segment in the form of a single component shown with a hoist drum design used with cables or wire ropes.
Figure 3:
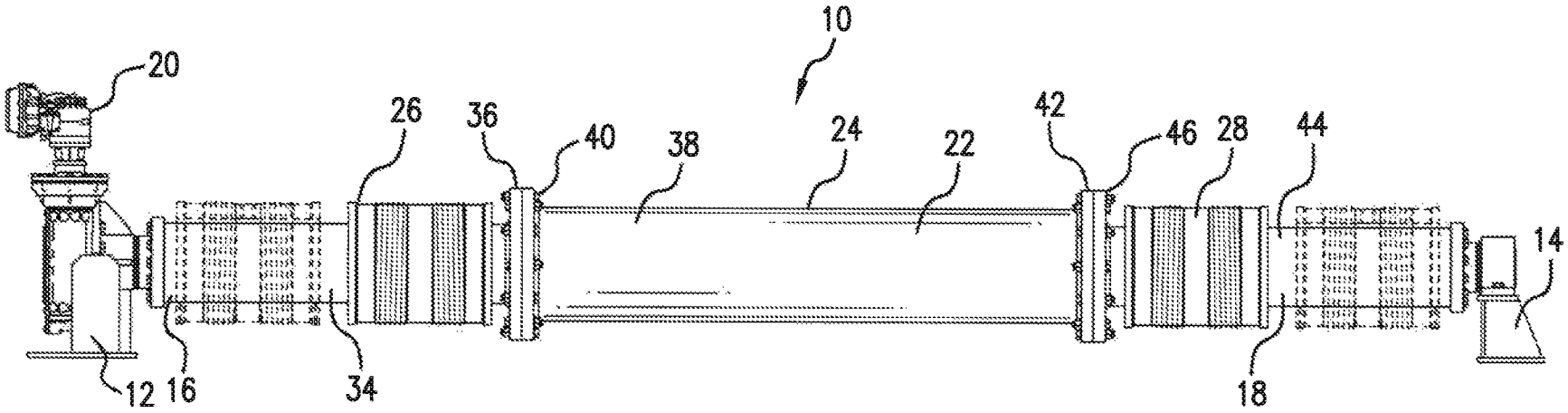
FIG. 3 shows a front elevation view of the configurable dam gate hoist of FIG. 2, with the hoist drums shown in the narrowest position and an alternative position of the hoist drums in the widest position shown in dashed lines.
Figure 4:
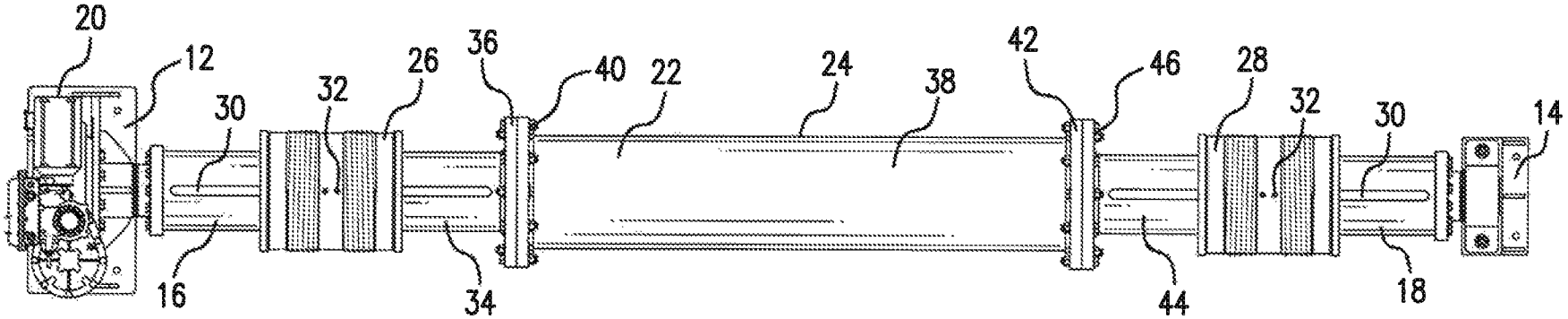
FIG. 4 shows a plan view of the configurable dam gate hoist of FIG. 2.
Figure 5:
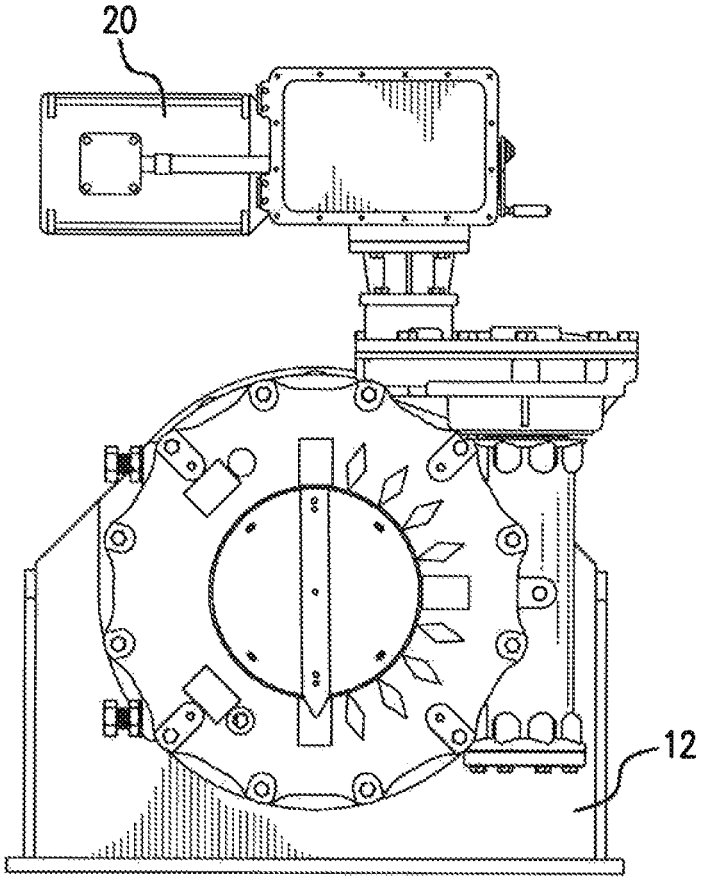
FIG. 5 shows a side elevation view of the configurable dam gate hoist of FIG. 2 shown from the first side segment side of the hoist.
Figure 6:
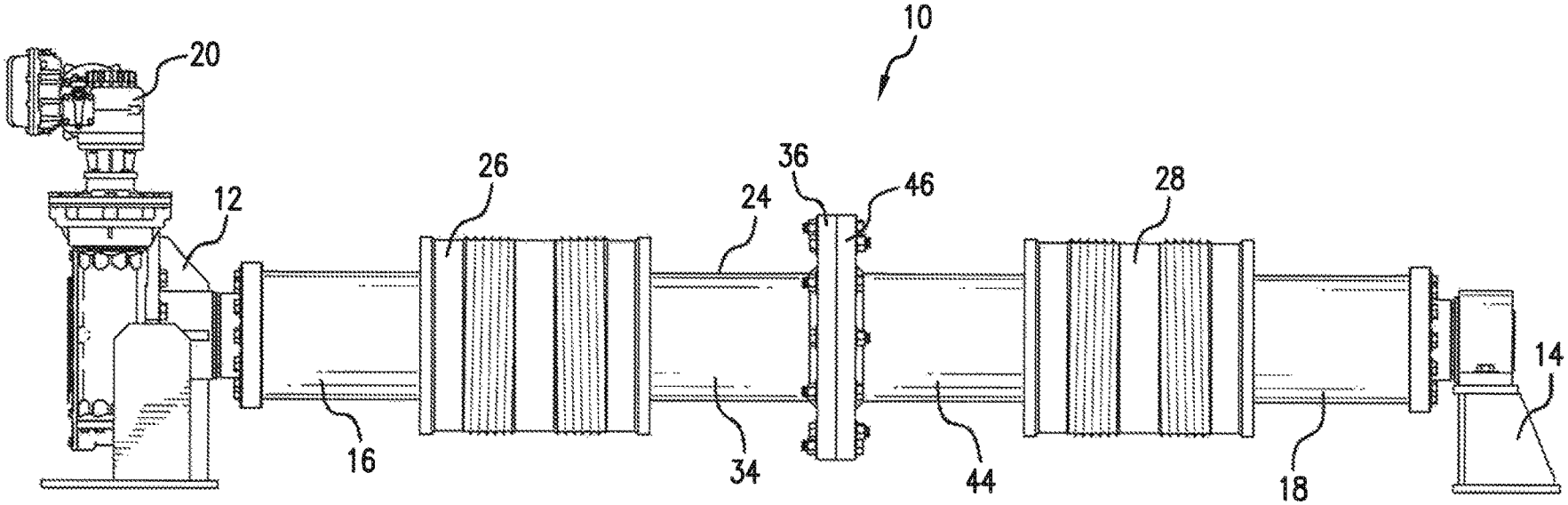
FIG. 6 shows a front elevation view of the configurable dam gate hoist of FIG. 1.
Figure 7:
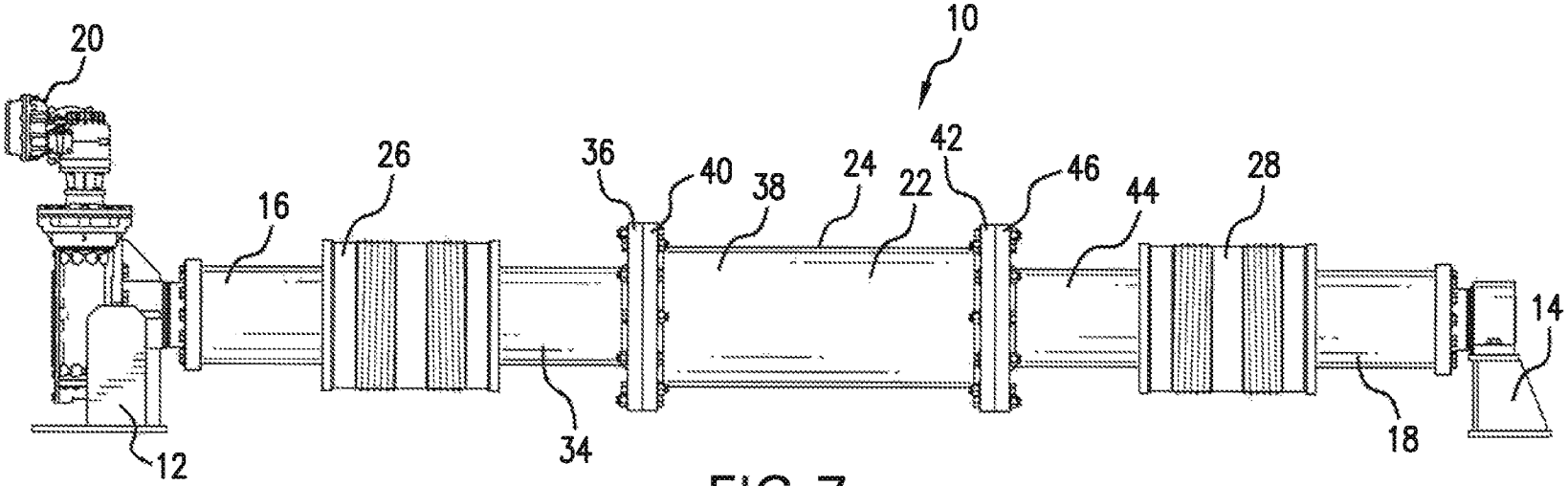
FIG. 7 shows a front elevation view of the configurable dam gate hoist of the present invention with the optional middle segment in the form of a single component of a shorter length shown with a hoist drum design used with cables or wire ropes.

Referring now to FIGS. 1-10, one preferred embodiment of a modular and configurable dam gate hoist 10 of the present invention is shown. The configurable dam gate hoist 10 generally comprises a first hoist support frame 12, second hoist support frame 14, first side segment 16, second side segment 18, and a hoist drive assembly 20 (as shown in FIGS. 1 and 6). Optionally, the configurable dam gate hoist 10 may also include a middle segment 22 (as shown in FIGS. 2-5 and 7-10); that is, the configurable dam gate hoist 10 of the present invention may entirely omit the middle segment 22, such that only the first side segment 16 and second side segment 18 are utilized as a tube 24 without departing from the scope of the present invention. The first side segment 16 and second side segment 18 (or the first side segment 16, second side segment 18, and optional middle segment 22, when the middle segment 22 is utilized) are joined together to form a tube 24 of the configurable dam gate hoist 10.

The first side segment 16 comprises a cylindrical portion 34 and a flange 36, with the flange 36 on the end of the first side segment 16 adjacent to the second side segment 18, or the middle segment 22 where the middle segment 22 is utilized. The flange 36 of the first side segment 16 includes a plurality of bolt apertures for receiving a plurality of bolts to secure the first side segment 16 to the second side segment 18, or the middle segment 22 as applicable. Although the use of a plurality of bolt apertures for receiving a plurality of bolts to secure the first side segment 16 to the second side segment 18, or the middle segment 22 as applicable is discussed herein, the joint between the first side segment 16 and the second side segment 18, or the middle segment 22 as applicable, may be any type of joint with sufficient strength to adequately transfer torque from the first side segment 16 to the second side segment 18, or the middle segment 22 as applicable, and resist loads on the tube 24 from the dam gate. For example, the joint may be held together by threaded studs, clevis pins, clamps, and a variety of other fasteners and the like.

The opposite end of the first side segment 16 includes an extension that extends into an aperture in the first hoist support frame 12 to allow the first hoist support frame 12 to support the tube 24 while still allowing it to rotate relative to the first hoist support frame 12. The extension may take the form of any hardware known in the art which is necessary to be received by the corresponding aperture in the first hoist support frame 12.

The length of the first side segment 16 may be any length that provides sufficient strength for the tube 24 to hold the weight of the dam gate when the dam gate is raised. The overall length of the first side segment 16 is primarily dependent upon the desired range of adjustment for the first hoist drum 26. For example, in one preferred embodiment of the present invention, the first side segment 16 has a length of 80.75 inches, which allows the first hoist drum 26 to be adjusted over a total distance of six (6) feet (three feet to either side of the center of the second side segment 18).

Likewise, the first side segment 16 may have any diameter and thickness that provides sufficient strength for the tube 24 to hold the weight of the dam gate when the dam gate is raised. Preferably, when the first side segment 16 has a diameter of 17-19 inches and a standard industrial thickness.

The first side segment 16 also includes a drum adjustment keyway or slot 30, or other similar means for engaging the first hoist drum 26, which runs longitudinally along the outer surface of the cylindrical portion 34 of the first side segment 16. The drum adjustment keyway or slot 30 extends over most of the length of the cylindrical portion 34 of the first side segment 16 and ends just short of the flange 36 of the first side segment 16 and the extension on the opposite end of the first side segment 16.

Preferably, the drum adjustment keyway or slot 30 has a rectangular cross-section, such that it corresponds with an industry standard square key that is preferably included as part of the adjustment bolts 32. However, alternatively, the drum adjustment keyway or slot 30 may have a cross-section of any shape known in the art. While a drum adjustment keyway or slot 30 is discussed herein, alternatively any other means known in the art may be used to secure the first hoist drum 26 to the first side segment 16 such that the first hoist drum 26 is secured to the first side segment 16 but may still be adjusted longitudinally along the outer surface of the cylindrical portion 34 of the first side segment 16 as desired.

When it is utilized, the optional middle segment 22 comprises one or more middle segment components, each of which comprises a cylindrical portion 38, a first flange 40 on one end, and a second flange 42 on the opposite end. The first flange 40 of the each middle segment component includes a plurality of bolt apertures, which correspond to the bolt apertures of the flange 36 of either the first side segment 16 or the second flange 42 of the neighboring middle segment component, for receiving a plurality of bolts to secure the first side segment 16 to the middle segment 22 or middle segment components together, as applicable. To secure the first side segment 16 to the middle segment 22 (or middle segment components together) a plurality of bolts are inserted into the apertures of the flange 36 of the first side segment 16, or neighboring middle segment component, and the apertures of the first flange 40 of the middle segment 22 and then nuts are threaded onto the bolts and tightened. Likewise, second flange 42 of each middle segment component includes a plurality of bolt apertures, which correspond to the bolt apertures of the flange 46 of either the second side segment 18 or the first flange 40 of the neighboring middle segment component, for receiving a plurality of bolts to secure the second side segment 18 to the middle segment 22 or middle segment components together, as applicable. To secure the second side segment 18 to the second flange 42 of the middle segment 22 (or middle segment components together) a plurality of bolts are inserted into the apertures of the flange 46 of the second side segment 18, or neighboring middle segment component, and the apertures of the second flange 46 of the middle segment 22 and then nuts are threaded onto the bolts and tightened.

Although the use of a plurality of bolt apertures for receiving a plurality of bolts to secure the middle segment components together and to secure the middle segment 22 to the first side segment 16 and second side segment 18 is discussed herein, the joint between the middle segment components or the middle segment 22 and the first side segment 16 and second side segment 18 may be any type of joint with sufficient strength to adequately transfer torque from the first side segment 16 and the second side segment 18 to the middle segment 22 of between middle segment components, and resist loads on the tube 24 from the dam gate. For example, the joint may be held together by threaded studs, clevis pins, clamps, and a variety of other fasteners and the like.

Thus, when it is utilized, the full optional middle segment 22 (regardless of how many middle segment components are utilized to construct the middle segment 22) comprises a first flange 40 on one end of the middle segment 22 and a second flange 42 on the opposite end of the middle segment 22. The first flange 40 of the middle segment 22 includes a plurality of bolt apertures, which correspond to the bolt apertures of the flange 36 of the first side segment 16, for receiving a plurality of bolts to secure the first side segment 16 to the middle segment 22. To secure the first side segment 16 to the middle segment 22 a plurality of bolts are inserted into the apertures of the flange 36 of the first side segment 16 and the apertures of the first flange 40 of the middle segment 22, and then nuts are threaded onto the bolts and tightened.

Figure 8:
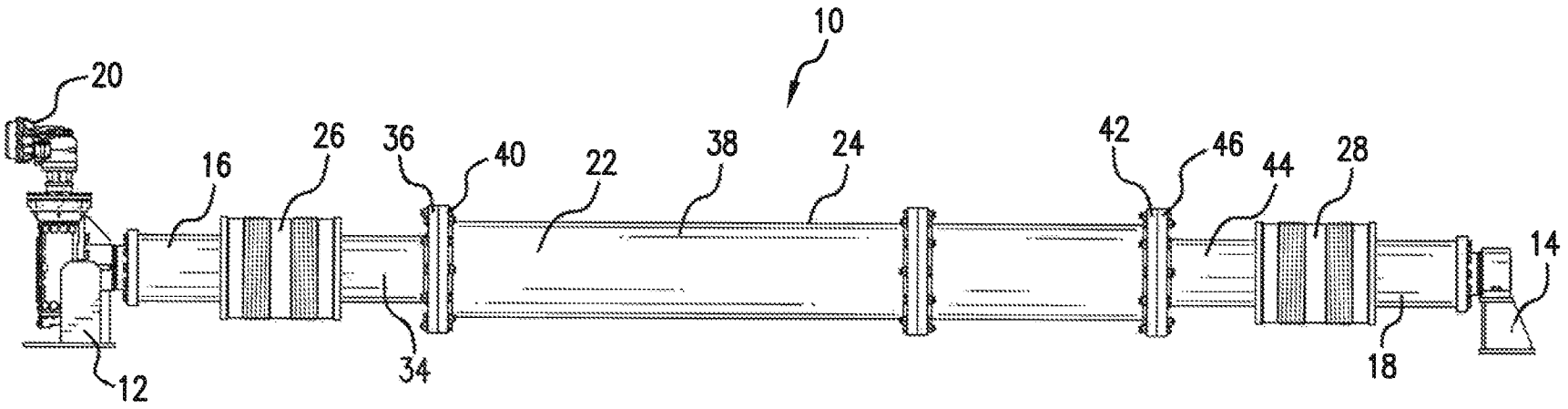
FIG. 8 shows a front elevation view of the configurable dam gate hoist of the present invention with the optional middle segment in the form of two middle segment components shown with a hoist drum design used with cables or wire ropes.
Figure 9:
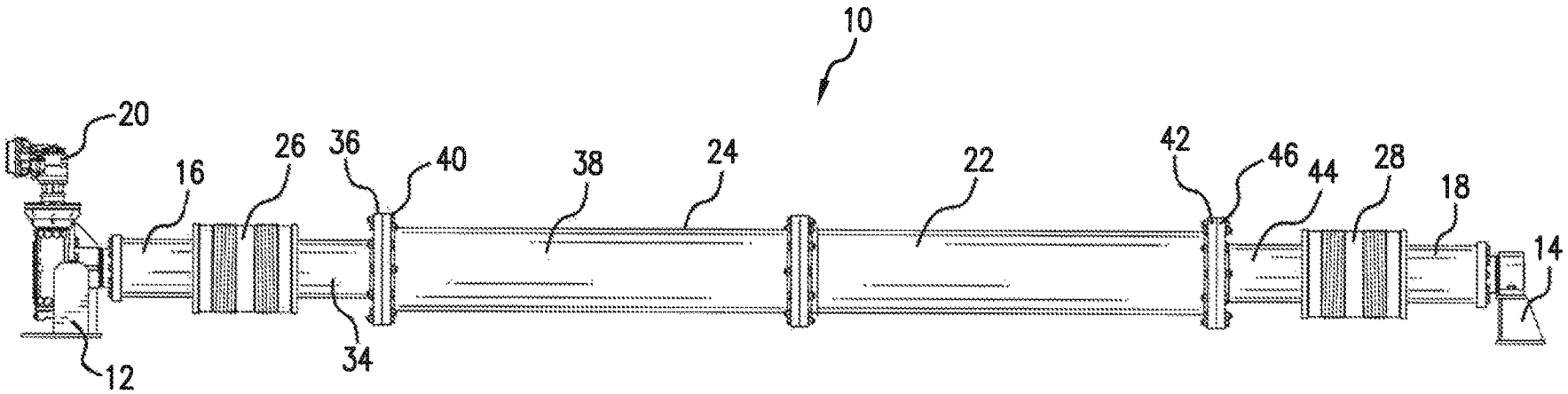
FIG. 9 shows a front elevation view of the configurable dam gate hoist of the present invention with the optional middle segment in the form of two middle segment components shown with a hoist drum design used with cables or wire ropes.
Figure 10:
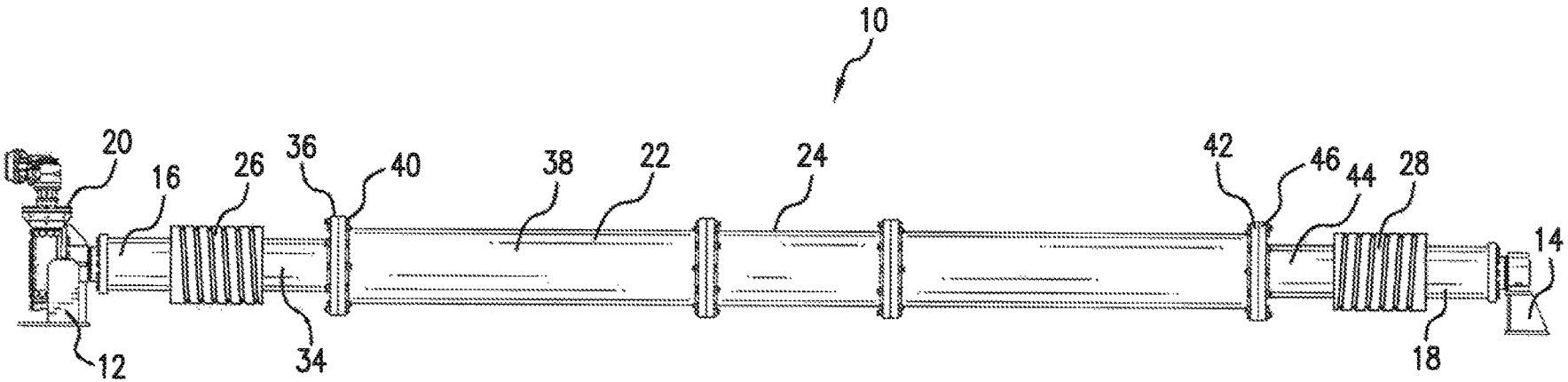
FIG. 10 shows a front elevation view of the configurable dam gate hoist of the present invention with the optional middle segment in the form of three middle segment components shown with a hoist drum design used with chains.

The optional middle segment 22 has a length selected from one or more pre-determined lengths at the manufacturing facility based upon the overall length of the tube 24 required for a particular installation. That is, middle segment components having several different pre-selected lengths are manufactured at the manufacturing facility, and then the middle segment 22 giving the overall desired length of the tube 24 is assembled from one or more of these components, such that the positions of the load bearing first hoist support frame 12 and second hoist support frame 14 may be placed where required. For example, preferred embodiments of the present invention utilizing a single middle segment 22 are shown in FIGS. 2-5 and 7 and preferred embodiments of the present invention utilizing a middle segment 22 comprising two or more middle segment components are shown in FIGS. 8-10.

Preferably, there are a variety of lengths for the middle segment components available. For example, in one preferred embodiment of the present invention, components of the middle segment 22 have length options of 5 and 10 feet, and middle segments 22 having various lengths may be constructed using those basic lengths. For example, where a middle segment length of 20 feet is desired, it may be constructed from two 10 foot components, and where a middle segment length of 25 feet is desired, it may be constructed from two 10 foot components and one 5 foot component.

Similarly, the optional middle segment 22 may have any diameter and thickness that provides sufficient strength for the tube 24 to hold the weight of the dam gate when the dam gate is in its raised position. For example, when the middle segment 22 is constructed of components having lengths of 5 or 10 feet, it will have a diameter of 24-25 inches and a sufficient wall thickness to resist bending or breaking.

This variable length of the middle segment 22 (and the components thereof) allows the configurable dam gate hoist 10 to be modular and configurable to a specific dam gate and dam pier configuration by varying the overall length of the tube 24 which allows the load bearing first hoist support frame 12 and second hoist support frame 14 to be positioned as required by a specific site, while avoiding the need to custom manufacture a dam gate hoist specific to such a dam gate and dam pier configuration.

The second side segment 18 comprises a cylindrical portion 44 and a flange 46, with the flange 46 on the end of the second side segment 18 adjacent to the first side segment 16, or the middle segment 22 when the middle segment 22 is utilized. The flange 46 of the second side segment 18 includes a plurality of bolt apertures which correspond to the bolt apertures of the flange 36 of the first side segment 16, or the second flange 42 of the middle segment 22 when the middle segment 22 is utilized, for receiving a plurality of bolts to secure the second side segment 18 to the first side segment 16 or the middle segment 22, as applicable. To secure the second side segment 18 to the first side segment 16 or the middle segment 22, as applicable, a plurality of bolts are inserted into the apertures of the flange 46 of the second side segment 18 and the apertures of the flange 36 of the first side segment 16, or the second flange 42 of the middle segment 22 when the middle segment 22 is utilized, and then nuts are threaded onto the bolts and tightened. Although the use of a plurality of bolt apertures for receiving a plurality of bolts to secure the second side segment 18 to the first side segment 16, or the middle segment 22 as applicable is discussed herein, the joint between the second side segment 18 and the first side segment 16, or the middle segment 22 as applicable, may be any type of joint with sufficient strength to adequately transfer torque from the first side segment 16 to the second side segment 18, or the middle segment 22 to the second side segment 18 as applicable, and resist loads on the tube 24 from the dam gate. For example, the joint may be held together by threaded studs, clevis pins, clamps, and a variety of other fasteners and the like.

The opposite end of the second side segment 18 includes an extension that extends into an aperture in the second hoist support frame 14 to allow the second hoist support frame 14 to support the tube 24 while still allowing it to rotate relative to the second hoist support frame 14. The extension may take the form of any hardware known in the art which is necessary to be received by the corresponding aperture in the second hoist support frame 14.

The length of the second side segment 18 may be any length that provides sufficient strength for the tube 24 to hold the weight of the dam gate when the dam gate is in its raised position. The overall length of the second side segment 18 is primarily dependent upon the desired range of adjustment for the second hoist drum 28. For example, in one preferred embodiment of the present invention, the second side segment 18 has a length of 80.75 inches, which allows the second hoist drum 28 to be adjusted over a total distance of six (6) feet (three feet to either side of the center of the second side segment 18).

Likewise, the second side segment 18 may have any diameter and thickness that provides sufficient strength for the tube 24 to hold the weight of the dam gate when the dam gate is in its raised position. Preferably, when the second side segment 18 has a diameter of 17-19 inches and a standard industrial thickness.

The second side segment 18 also includes the drum adjustment keyway or slot 30, or other similar means for engaging the second hoist drum 28, which runs longitudinally along the outer surface of the cylindrical portion 44 of the second side segment 18. The drum adjustment keyway or slot 30 extends over most of the length of the cylindrical portion 44 of the second side segment 18 and ends just short of the flange 46 of the second side segment 18 and the extension on the opposite end of the second side segment 18.

Preferably, the drum adjustment keyway or slot 30 has a rectangular cross-section, such that it corresponds with an industry standard square key that is preferably included as part of the adjustment bolts 32. However, alternatively, the drum adjustment keyway or slot 30 may have a cross-section of any shape known in the art. While a drum adjustment keyway or slot 30 is discussed herein, alternatively any other means known in the art may be used to secure the second hoist drum 28 to the second side segment 18 such that the second hoist drum 28 is secured to the second side segment 18 but may still be adjusted longitudinally along the outer surface of the cylindrical portion 44 of the second side segment 18 as desired.

The first hoist drum 26 is generally cylindrical in shape is mounted on the first side segment 16 of the configurable dam gate hoist 10 for receiving one of the chains, cables, or wire ropes 102 attached to the dam gate. The inside diameter of the first hoist drum 26 is slightly larger than the outside diameter of the cylindrical portion 34 of the first side segment 16, such that the first side segment 16 extends through the interior of the first hoist drum 26 and the first hoist drum 26 may be shifted longitudinally along the first side segment 16.

For example, in one preferred embodiment of the present invention, the first hoist drum 26 has an outer diameter of 25.88 inches and a standard industrial thickness that results in an inner diameter of a bit more than the 17-19 inch outer diameter of the first side segment 16 of such an embodiment.

The first hoist drum 26 has any length that provides sufficient space to hold the required length of the chain, cable, or wire rope 102 of the dam gate when the dam gate is in its raised position. For example, in one preferred embodiment of the present invention that includes a length of the first hoist drum 26 that is sufficient to hold most typical lengths of such chains, cables, or wire ropes, the first hoist drum 26 has a length of 30 inches.

The first hoist drum 26 includes one or more adjustment bolts 32 that are received by the drum adjustment keyway or slot 30 of the first side segment 16. Preferably, the adjustment bolts 32 include an industry standard square key that corresponds to and is received by the drum adjustment keyway or slot 30 to more securely engage the drum adjustment keyway or slot 30. When the adjustment bolts 32 are in a loosened configuration, the adjustment bolts 32 allow the longitudinal position of the first hoist drum 26 to be adjusted along the first side segment 16. Then, when the desired position for the first hoist drum 26 is reached, based upon the desired fleet angle for the chain, cable, or wire rope 102 of the dam gate (one end of which is secured to the first hoist drum 26), the adjustment bolts 32 are rotated into a tightened configuration where the adjustment bolts 32 engage the drum adjustment keyway or slot 30 of the first side segment 16, thereby securing the first hoist drum 26 to the first side segment 16. Thus, once the adjustment bolts 32 have been tightened, the first hoist drum 26 is held in the position that corresponds with the desired fleet angle of the chains, cables, or wire ropes 102 of the dam gate to allow the dam gate to be raised and lowered properly. While the distance over which the first hoist drum 26 may be shifted varies based upon the length of the first side segment 16, in one preferred embodiment of the configurable dam gate hoist 10 the first hoist drum 26 may be shifted up to one and one-half (1.5) feet in either direction from the center of the first side segment 16, for a total covered distance of six (6) feet. It should be noted that while the use of adjustment bolts 32 are discussed herein, alternatively any other means of axial locking the first hoist drum 26 to the first side segment 16 which allows the transmission of torque from the first side segment 16 to the first hoist drum 26 known in the art may be utilized.

The second hoist drum 28 is generally cylindrical in shape and is mounted on the second side segment 18 of the configurable dam gate hoist 10 for receiving one of the chains, cables, or wire ropes 102 attached to the dam gate. The inside diameter of the second hoist drum 28 is slightly larger than the outside diameter of the cylindrical portion 44 of the second side segment 18, such that the second side segment 18 extends through the interior of the second hoist drum 28, and the second hoist drum 28 may be shifted longitudinally along the second side segment 18.

For example, in one preferred embodiment of the present invention, the second hoist drum 28 has an outer diameter of 25.88 inches and a sufficient wall thickness to resist bending or breaking that results in an inner diameter of a bit more than the 17-19 inch outer diameter of the second side segment 18 of such an embodiment.

The second hoist drum 28 has any length that provides sufficient space to hold the required length of the chain, cable, or wire rope 102 of the dam gate when the dam gate is in its raised position. For example, in one preferred embodiment of the present invention that includes a length of the second hoist drum 28 that is sufficient to hold most typical lengths of such chains, cables, or wire ropes, the second hoist drum 28 has a length of 30 inches.

The second hoist drum 28 includes one or more adjustment bolts 32 that are received by the drum adjustment keyway or slot 30 of the second side segment 18. Preferably, the adjustment bolts 32 include an industry standard square key that corresponds to and is received by the drum adjustment keyway or slot 30 to more securely engage the drum adjustment keyway or slot 30. When the adjustment bolts 32 are in a loosened configuration, the adjustment bolts 32 allow the longitudinal position of the second hoist drum 28 to be adjusted along the second side segment 18. Then, when the desired position for the second hoist drum 28 is reached, based upon the desired fleet angle for the chain, cable, or wire rope 102 of the dam gate (one end of which is secured to the second hoist drum 28), the adjustment bolts 32 are rotated into a tightened configuration where the adjustment bolts 32 engage the drum adjustment keyway or slot 30 of the second side segment 18, thereby securing the second hoist drum 28 to the second side segment 18. Thus, once the adjustment bolts 32 have been tightened, the second hoist drum 28 is held in the position that corresponds with the desired fleet angle of the chains, cables, or wire ropes 102 of the dam gate to allow the dam gate to be raised and lowered properly. While the distance over which the second hoist drum 28 may be shifted varies based upon the length of the second side segment 18, in one preferred embodiment of the configurable dam gate hoist 10 the second hoist drum 28 may be shifted up to one and one-half (1.5) feet in either direction from the center of the first side segment 16, for a total covered distance of six (6) feet. It should be noted that while the use of adjustment bolts 32 are discussed herein, alternatively any other means of axial locking the second hoist drum 28 to the second side segment 18 which allows the transmission of torque from the second side segment 18 to the second hoist drum 28 known in the art may be utilized.

The general design of the outer surfaces of the first hoist drum 26 and second hoist drum 28 varies based upon whether the configurable dam gate hoist 10 will be used with a dam gate with cables, wire ropes, or chains.

As best shown in FIGS. 1-9, if cables or wire ropes will be used to raise and lower the dam gate, the first hoist drum 26 and second hoist drum 28 have a generally smooth surface with flanges or lips extending upward from the surface at each end of each drum. As the cables or wire ropes raise the dam gate, the cables or wire ropes coil around each drum, slowly wrapping around the smooth area in the middle of the applicable drum. The flanges or lips extending upward from the surface of the drum at each end ensure that the cables or wire ropes stay located within the smooth area of each drum and do not fall off onto the applicable side segment.

As best shown in FIG. 10, if chains will be used to raise and lower the dam gate, the surface of the first hoist drum 26 and the second hoist drum 28 includes a slot that corkscrews along the surface of the drum to hold the thicker chains as they coil around each drum. The width of the corkscrew slot is such that they are slightly larger than the width of the chain, such that the chain fits within the corkscrew slot. The depth of the corkscrew slot is such that the chain can be held within the corkscrew slot without sliding axially along the first hoist drum 26 or the second hoist drum 28.

A first hoist drum 26 or second hoist drum 28 of one general design may easily be exchanged for the drum of the other general design when the configurable dam gate hoist 10 is being configured in the factory. To change the general design used for the first hoist drum 26 or second hoist drum 28, the undesired drum is removed from its respective side segment by loosening the adjustment bolts 32 and sliding the drum off of the end of the side segment. The desired drum is then slid back onto the side segment and then secured it to the respective side segment with the adjustment bolts 32.

While two different general designs for the surfaces of the first hoist drum 26 and second hoist drum 28 are discussed herein, it will be recognized by one skilled in the art that any general surface design known in the art that is used with cables, wire ropes, or chains of dam gates may be utilized as the surface of the first hoist drum 26 and second hoist drum 28 without departing from the scope of the present invention.

The first hoist support frame 12 secures the tube 24 to the dam above the dam gate while allowing the tube 24 to rotate relative to the first hoist support frame 12. The extension of the first side segment 16 extends into, and is held by, a support aperture in the first hoist support frame 12. The first hoist support frame 12 may take any form for a hoist support frame known in the art, but typically comprises a horizontal base for securing the first hoist support frame 12 to the dam, and a vertical member extending upward from the horizontal base which defines the support aperture for holding the extension of the first side segment 16. The first hoist support frame 12 may also include additional support members which provide additional strength and support to the vertical member and/or the support aperture. The support aperture includes bearings that allow the first side segment 16 and, therefore, the tube 24, to easily rotate relative to the first hoist support frame 12 when the configurable dam gate hoist 10 raises or lowers the dam gate.

The first hoist support frame 12 also includes the hoist drive assembly 20, which is preferably secured to the first hoist support frame 12. Generally, the hoist drive assembly 20 is secured to the horizontal base or vertical member of the first hoist support frame 12. While it is preferable to have the hoist drive assembly 20 to be secured to or mounted on the first hoist support frame 12, it may alternatively be mounted on the dam adjacent to the first hoist support frame 12 without departing from the scope of the present invention. The hoist drive assembly 20 may take the form of any type of hoist drive known in the art, but preferably is an electric motor.

The motor of the hoist drive assembly 20 engages the extension of the first side segment 16. When the hoist drive assembly 20 operates, it rotates the extension of the first side segment 16, which then causes the first side segment 16 and the rest of the tube 24 to rotate. The rotation of the tube 24 likewise causes the first hoist drum 26 and second hoist drum 28 to rotate. The rotation of the first hoist drum 26 and second hoist drum 28 causes the chains, cables, or wire ropes 102 of the dam gate to wrap around the first hoist drum 26 and second hoist drum 28, thereby raising the dam gate. When the desired position of the dam gate is reached, the hoist drive assembly 20 is turned off and the dam gate is held in position by the chains, cables, or wire ropes 102.

Typically, it is not necessary for the motor of the hoist drive assembly 20 to include a brake for slowing the descent of the dam gate when the dam gate is being lowered. Instead, the hoist drive assembly 20 typically includes an anti-backdrive worm reducer with a ratio large enough that it effectively acts as a brake preventing the dam gate from descending too quickly (for example, it may have a ratio of 60 to 1 or more). That is, the large ratio of the worm reducer of the hoist drive assembly 20 is such that when the dam gate is to be closed, the motor provides just enough torque to overcome the worm friction, thereby allowing the dam gate to lower and close in a controlled fashion. However, alternatively a drive assembly with a different reduction assembly and a brake motor or machinery brake may be utilized without departing from the scope of the present invention.

In certain cases it may be desirable for the motor of the hoist drive assembly 20 to include a torque limiter and/or a travel limiter to control the functioning of the motor. For example, in one preferred embodiment of the present invention the motor of the hoist drive assembly 20 includes integral torque limits and integral travel limits so that the hoist drive assembly 20 is configurable to site specific lifting conditions of the dam gate with which the configurable dam gate hoist 10 will be used, which will protect the dam gate from excessive lifting forces and gate overtravel. An example of a torque limiter that may be utilized is an electromechanical spring pack and an example of a travel limiter that may be used is an electromechanical rotary gear pack. However, alternatively, any torque or travel limiter known in the art may be used in conjunction with the motor of the hoist drive assembly 20.

Additionally, it is preferable that the hoist drive assembly 20 be configurable to operate with various types of voltages by utilizing modular transformers that are readily available at the manufacturing facility for the configurable dam gate hoist 10. For example, the hoist drive assembly 20 might be designed for a 480 VAC power supply but the specific site that will be using the configurable dam gate hoist is only served by 240 VAC power. In such a case, the configurable dam hoist 10 would be delivered with a modular transformer located between the site's power supply and the hoist drive assembly 20 of the configurable dam gate hoist 10 so that the hoist drive assembly 20 can operate using the existing on-site power supply. Thus, the configurable dam gate hoist 10 maybe operated using different types of existing power source voltages that may be present at different sites.

The second hoist support frame 14 secures the tube 24 to the desired load bearing location on the dam structure while allowing the tube 24 to rotate relative to the second hoist support frame 14. The extension of the second side segment 18 extends into, and is held by, a support aperture in the second hoist support frame 14. The second hoist support frame 14 may take any form for a hoist support frame known in the art, but typically comprises a horizontal base for securing the second hoist support frame 14 to the dam and a vertical member extending upward from the horizontal base which defines the support aperture for holding the extension of the second side segment 18. The second hoist support frame 14 may also include additional support members which provide additional strength and support to the vertical member and/or the support aperture. The support aperture includes bearings that allow the second side segment 18, and therefore the tube 24, to easily rotate relative to the second hoist support frame 14 when the configurable dam gate hoist 10 raises or lowers the dam gate.

The present invention provides a modular and configurable dam gate hoist 10 that may be used with spillway and dam gates of various dimensions and weights having a variety of dam pier and gate chain configurations by including hoist drums 20 that may be longitudinally adjusted along the side segments 16, 18 of the tube 24 to correspond with the desired fleet angle of the chains, cables, or wire ropes 102 of the dam gate and, optionally, a middle segment 22 that is constructed of pre-made components with pre-determined lengths at the factory to vary the length of the tube 24 to correspond to the location and configuration of the dam piers or other support structures. As such, the configurable dam gate hoist 10 of the present invention avoids the requirement of designing and fabricating a tube with a custom length and hoist drums having a custom location longitudinally along the tube based upon the specific dimensions of a dam gate and associated dam piers or other support structure of a dam. The present invention therefore greatly reduces the time and expense necessary to manufacture and install a dam gate hoist, or to replace an existing dam gate hoist in an emergency.

It will be recognized by one skilled in the art that while the configurable dam gate hoist 10 of the present invention is discussed herein with respect to dam gates, the configurable dam gate hoist 10 of the present invention may also be, or alternatively be, utilized with spillway gates, barrage or pick up weir gates, power outlet or intake gates, draft tube gates, or outlet/sluice/head regulator gates without departing from the scope of the present invention.

Likewise, it will be recognized by one skilled in the art that the size, configuration, or dimensions of the configurable dam gate hoist 10 of the present invention may be adjusted to allow for use with various sizes of dam gates and gate chains, as may be desired by the end user of the attachment. Likewise, it will be recognized by one skilled in the art that the materials from which the configurable dam gate hoist 10 of the present invention is made may be varied without departing from the scope of the present invention.

While the invention has been described in the specification and illustrated in the drawings with reference to certain preferred embodiments, it will be understood by those skilled in the art that various changes may be made and equivalents may be substituted for elements thereof without departing from the scope of the present invention. In addition, many modifications may be made to adapt to a particular situation or material to the teachings of the invention without departing from the essential scope thereof. Therefore, it is intended that the present invention not be limited to the particular embodiments illustrated by the drawings and described in the specification as the best modes presently contemplated for carrying out the present invention, but that the present invention will include any embodiments falling within the description of the invention herein.

What is claimed is:

1. A configurable dam gate hoist comprising:

(a) a first hoist support frame;

(b) a first side segment, including a first hoist drum, wherein the first hoist drum is adjustable along the longitudinal axis of the first side segment and includes at least one aperture for receiving at least one drum adjustment bolt, and wherein the first side segment includes a first drum adjustment slot running longitudinally along the surface of the first side segment;

(c) a second side segment, including a second hoist drum, wherein the second hoist drum is adjustable along the longitudinal axis of the second side segment and includes at least one aperture for receiving at least one drum adjustment bolt, and wherein the second side segment includes a second drum adjustment slot running longitudinally along the surface of the second side segment;

(d) a second hoist support frame; and (e) a hoist drive assembly, wherein the hoist drive assembly is coupled to the first side segment for imparting a rotational motion upon the first side segment and second side segment, such that the first side segment and second side segment rotate relative to the first hoist support and second hoist support.

2. The configurable dam gate hoist of claim 1, wherein at least one drum adjustment bolt of the first hoist drum extends into the first drum adjustment slot of the first side segment and at least one drum adjustment bolt of the second hoist drum extends into the second drum adjustment slot of the second side segment.

3. The configurable dam gate hoist of claim 2, wherein the at least one drum adjustment bolt of the first hoist drum includes a square key that extends into the first drum adjustment slot of the first side segment and the at least one drum adjustment bolt of the second hoist drum includes a square key that extends into the second drum adjustment slot of the second side segment.

4. The configurable dam gate hoist of claim 2, wherein at least one drum adjustment bolt of the first hoist drum engages the first drum adjustment slot of the first side segment to secure the first hoist drum in a desired position, and at least one drum adjustment bolt of the second hoist drum engages the second drum adjustment slot of the second side segment to secure the second hoist drum in a desired position.

5. The configurable dam gate hoist of claim 1, wherein the first side segment comprises a cylindrical portion and a flange, and the second side segment comprises a cylindrical portion and a flange.

6. The configurable dam gate hoist of claim 5, wherein the flange of a first side segment defines a plurality of apertures for receiving a plurality of bolts, and the flange of the second side segment defines a plurality of apertures for receiving a plurality of bolts.

7. The configurable dam gate hoist of claim 6, wherein a plurality of bolts extend through the plurality of apertures of the flange of the first side segment and the plurality of apertures of the flange of the second side segment, such that the first side segment is secured to the second side segment.

8. The configurable dam gate hoist of claim 1, further comprising a middle segment, wherein the hoist drive assembly is coupled to the first side segment for imparting a rotational motion upon the first side segment, middle segment, and second side segment, such that the first side segment, middle segment, and second side segment rotate relative to the first hoist support and second hoist support, and wherein the middle segment is pre-manufactured to have one of a plurality of pre-determined lengths, such that the total length of the first side segment, middle segment, and second side segment may be selected to correspond with the distance between load bearing structures of a specific dam gate.

9. The configurable dam gate hoist of claim 8, wherein the first side segment comprises a cylindrical portion and a flange, the middle segment comprises a first flange, a cylindrical portion, and a second flange, and the second side segment comprises a cylindrical portion and a flange.

10. The configurable dam gate hoist of claim 9, wherein the flange of a first side segment defines a plurality of apertures for receiving a plurality of bolts, the first flange of the middle segment defines a plurality of apertures for receiving a plurality of bolts, the second flange of the middle segment defines a plurality of apertures for receiving a plurality of bolts, and the flange of the second side segment defines a plurality of apertures for receiving a plurality of bolts.

11. The configurable dam gate hoist of claim 10, wherein a plurality of bolts extend through the plurality of apertures of the flange of the first side segment, and the plurality of apertures of the first flange of the middle segment, and a plurality of bolts extend through the plurality of apertures of the second flange of the middle segment, and the plurality of apertures of the flange of the second side segment, such that the first side segment and second side segment are secured to the middle segment.

12. The configurable dam gate hoist of claim 8, wherein the first side segment comprises a cylindrical portion and a flange, the second side segment comprises a cylindrical portion and a flange, and the middle segment comprises a plurality of middle segment components, where each middle segment component comprises a first flange, a cylindrical portion, and a second flange.

13. The configurable dam gate hoist of claim 12, wherein the flange of a first side segment defines a plurality of apertures for receiving a plurality of bolts, the flange of the second side segment defines a plurality of apertures for receiving a plurality of bolts, the first flange of each of the middle segment components of the middle segment defines a plurality of apertures for receiving a plurality of bolts, and the second flange of the middle segment defines a plurality of apertures for receiving a plurality of bolts.

14. The configurable dam gate hoist of claim 13, wherein the middle segment is formed by securing the middle segment components of the middle segment together by extending a plurality of bolts through the plurality of apertures of the second flange of the middle segment component, and the plurality of apertures of the first flange of the neighboring middle segment component until all of the plurality of middle segment components have been secured together end-to-end to form the middle segment, and wherein a plurality of bolts are then extended through the plurality of apertures of the flange of the first side segment and the plurality of apertures of the first flange of the middle segment, and a plurality of bolts are extended through the plurality of apertures of the second flange of the middle segment, and the plurality of apertures of the flange of the second side segment, such that the first side segment and second side segment are secured to the middle segment.

15. The configurable dam gate hoist of claim 1, wherein at least one dam gate chain for raising a dam gate is secured to the first hoist drum, and at least one dam gate chain for raising the dam gate is secured to the second hoist drum.

16. The configurable dam gate hoist of claim 1, wherein at least one dam gate cable or wire rope for raising a dam gate is secured to the first hoist drum and at least one dam gate cable or wire rope for raising the dam gate is secured to the second hoist drum.

17. The configurable dam gate hoist of claim 16, wherein two dam gate cables or wire ropes for raising the dam gate is secured to the first hoist drum and two dam gate cables or wire ropes for raising the dam gate is secured to the second hoist drum.

18. The configurable dam gate hoist of claim 1, wherein the hoist drive assembly comprises a motor.

19. The configurable dam gate hoist of claim 18, wherein the torque limits of the hoist drive assembly are adjustable.

20. The configurable dam gate hoist of claim 18, wherein the travel limits of the hoist drive assembly are adjustable.

21. The configurable dam gate hoist of claim 18, wherein the motor is an electric motor.

22. The configurable dam gate hoist of claim 21, wherein the hoist drive assembly includes a transformer for receiving an electrical current having a predetermined voltage and outputting an electrical current having a different predetermined voltage to power and operate the motor of the hoist drive assembly.

23. The configurable dam gate hoist of claim 18 wherein the hoist drive assembly includes controls for operating the motor mounted on the hoist drive assembly.

24. The configurable dam gate hoist of claim 18, wherein the controls for operating motor of the hoist drive assembly are located remotely from the configurable dam gate hoist.

* * * * *